US011713098B2

(12) United States Patent
Aubeny et al.

(10) Patent No.: US 11,713,098 B2
(45) Date of Patent: Aug. 1, 2023

(54) MULTILINE RING ANCHOR AND INSTALLATION METHOD

(71) Applicant: The Texas A&M University System, College Station, TX (US)

(72) Inventors: Charles Aubeny, College Station, TX (US); Brian Diaz, College Station, TX (US); Sanjay Arwade, Amherst, MA (US); Don DeGroot, Amherst, MA (US); Melissa E. Landon, Orono, ME (US); Casey Fontana, Amherst, MA (US); Spencer Hallowell, Amherst, MA (US)

(73) Assignee: NATIONAL SCIENCE FOUNDATION, Alexandria, VA (US)

( * ) Notice: Subject to any disclaimer, the term of this patent is extended or adjusted under 35 U.S.C. 154(b) by 0 days.

(21) Appl. No.: 16/978,760

(22) PCT Filed: Mar. 28, 2019

(86) PCT No.: PCT/US2019/024667
§ 371 (c)(1),
(2) Date: Sep. 7, 2020

(87) PCT Pub. No.: WO2019/191486
PCT Pub. Date: Oct. 3, 2019

(65) Prior Publication Data

US 2020/0407021 A1 Dec. 31, 2020

Related U.S. Application Data

(60) Provisional application No. 62/649,457, filed on Mar. 28, 2018.

(51) Int. Cl.
*B63B 21/20* (2006.01)
*B63B 21/27* (2006.01)

(52) U.S. Cl.
CPC ..... *B63B 21/20* (2013.01); *B63B 21/27* (2013.01); *B63B 2021/203* (2013.01)

(58) Field of Classification Search
CPC ... B63B 21/20; B63B 21/27; B63B 2021/203; B63B 2035/446; B63B 21/26
See application file for complete search history.

(56) References Cited

U.S. PATENT DOCUMENTS 5,915,326 A * 6/1999 Karal ..... B63B 21/27 114/294
2014/0014021 A1 1/2014 Tomas

FOREIGN PATENT DOCUMENTS

| | | | |
|---|---|---|---|
| JP | 2004003292 | A | 1/2004 |
| KR | 101292236 | B1 | 7/2013 |
| WO | 2010/092361 | A2 | 8/2010 |
| WO | 2013/053936 | A1 | 4/2013 |

OTHER PUBLICATIONS

PCT/US2019/024667 International Search Report and Written Opinion dated Aug. 5, 2019 (11 p.).

* cited by examiner

*Primary Examiner* — Anthony D Wiest
(74) *Attorney, Agent, or Firm* — Conley Rose, P.C.

(57) ABSTRACT

A multiline ring anchor and a method for installing the multiline ring anchor is disclosed herein. The multiline ring anchor can be used for mooring systems for including, but limited to, arrays of offshore floating offshore wind turbines, wave power, and floating barriers.

19 Claims, 10 Drawing Sheets

MULTILINE RING ANCHOR AND INSTALLATION METHOD

CROSS-REFERENCE TO RELATED APPLICATIONS

This application is a 35 U.S.C. § 371 national stage application of PCT/US2019/024667 filed Mar. 28, 2019, and entitled "Multiline Ring Anchor and Installation Method," which claims priority to U.S. Provisional Patent Application Ser. No. 62/649,457, filed on Mar. 28, 2018, each of which is hereby incorporated herein by reference in its entirety for all purposes.

STATEMENT REGARDING FEDERALLY SPONSORED RESEARCH OR DEVELOPMENT

This invention was made with government support under grant No. 1463431, awarded by National Science Foundation. The government has certain rights in the invention.

FIELD

The disclosure relates generally to a ground anchor. The disclosure relates specifically to a ground anchor for an off-shore foundation and method for installing the ground anchor.

BACKGROUND

Offshore wind energy has an important role in meeting the renewable energy needs of the world. Mono piles, jacket constructions, or tripod constructions can be established on the seabed as foundations for offshore wind turbine installations. An estimated 60% of potentially exploitable offshore wind energy in the United States occurs at water depths beyond the range for which wind turbines can be fixed to the seabed. At these water depths, floating wind turbines moored to the seabed become the primary alternative. Anchors are commonly used onshore and offshore as foundation systems for structures such as floating offshore platforms and for floating renewable energy devices. Offshore and onshore anchors vary widely in shape, size, mode of installation, and usage, but they all raise the same challenge: the capital cost of support structures for offshore wind turbines can reach 25% of the development cost. Efficient design of the support structures, including the anchorage in the case of floating structures, is an important component in developing offshore wind energy resources at reasonable cost.

Thus problems associated with floating offshore platforms are anchoring the floating offshore platforms to the seabed with significantly varying soil conditions while reducing costs for seabed soil characterization; reducing anchor material, transportation, and installation costs; maintaining a versatility of a range of seabed soil conditions in which an anchor may be deployed; and providing anchorage for catenary mooring systems involving predominantly horizontal loads in addition to taut and semi-taut systems involving varying degrees of inclined loading. It would be advantageous to have a support structure in which these problems were addressed.

SUMMARY

Disclosed is a multiline ring anchor and a method for installing the anchor. The multiline ring anchor can be used for mooring systems for arrays of including, but not limited to, offshore floating offshore wind turbines. The anchor can reduce wind farm capital costs and is adaptable to the wide range of soil seabed conditions encountered in wind farm development and ensuring that the anchor can be utilized in all types of mooring systems for floating structures that are used in practice, including catenary, taut, and semi-taut systems. This anchor can also be used in other offshore renewable energy applications involving multiple production units, such as wave energy systems. In an embodiment, the anchor can be used as a floating barrier.

An embodiment of the disclosure is a multiline ring anchor comprising: a hollow cylindrical body, a plurality of pad-eyes attached to the outer surface of the hollow cylindrical body, and a plurality of mooring lines; wherein each of the mooring lines is attached to one of the plurality of pad-eyes. In an embodiment, the multiline ring anchor further comprises a plurality of wing plates appended to the outer surface of the hollow cylindrical body. In an embodiment, each of the plurality of wing plates is parallel to a vertical cylinder axis of the hollow cylindrical body. In an embodiment, the number of the plurality of wing plates is six. In an embodiment, the multiline ring anchor is a suction anchor. In an embodiment, both ends of the hollow cylindrical body are open. In an embodiment, the multiline ring anchor further comprises a plurality of plate stiffeners in the hollow cylindrical body. In an embodiment, each of the plurality of plate stiffeners is parallel to a vertical cylinder axis of the hollow cylindrical body. In an embodiment, each of the plurality of plate stiffeners cross the vertical cylinder axis. In an embodiment, the number of the plurality of plate stiffeners is six. In an embodiment, the multiline ring anchor further comprises a plurality of keying flaps attached to the plate stiffeners. In an embodiment, the multiline ring anchor further comprises a plurality of hinges connecting the keying flaps and the plate stiffeners. In an embodiment, each of the plurality of pad-eyes is positioned such that a line of action of a resultant mooring line force is configured to pass through a center of a rotational resistance of the anchor. In an embodiment, the number of the plurality of mooring lines is six.

An embodiment of the disclosure is a method for installing a multiline ring anchor, comprising: attaching the multiline ring anchor to a follower; penetrating the follower to a designated depth; extracting the follower, and leaving the multiline ring anchor embedded the depth. In an embodiment, the multiline ring anchor is installed by suction installation. In an embodiment, the multiline ring anchor is installed by hammer driven installation. In an embodiment, the suction installation is used in soft clay profiles or calcareous soils. In an embodiment, the hammer driven installation is used in sands, stiff clays, or stratified soil profiles. In an embodiment, the follower diameter is smaller than the diameter of the multiline ring anchor.

In an embodiment, the disclosure is directed to multiline ring anchor which comprises a hollow cylindrical body, a plurality of pad-eyes attached to the outer surface of the hollow cylindrical body, and a plurality of mooring lines, wherein each of the mooring lines is attached to corresponding pad-eyes respectively. In various embodiments, the multiline ring anchor is a suction anchor or both ends of the hollow cylindrical body is open.

In some embodiments, the multiline ring anchor comprises a plurality of wing plates appended to the outer surface of the hollow cylindrical body.

In some embodiments, a plurality of plate stiffeners are embedded within the hollow cylindrical body; wherein the plate stiffeners are configured to structurally reinforce the shell of the cylindrical body. Each of the plate stiffeners is parallel to a vertical cylinder axis of the hollow cylindrical body.

In some embodiments, a plurality of keying flaps are attached to the plate stiffeners through a plurality of hinges.

In some embodiments, each of the pad-eyes is positioned such that a line of action of a resultant mooring line force is configured to pass through a center of a rotational resistance of the anchor. In an embodiment, the number of the mooring lines is six.

In other embodiments, the disclosure is directed to a method for installing a multiline ring anchor, comprising attaching the multiline ring anchor to a follower, penetrating the follower to a designated depth; extracting the follower; and leaving the multiline ring anchor embedded at the designated depth.

In some embodiments, the multiline ring anchor is installed by either suction or hammer driven installation. The suction installation is used in soft clay profiles or calcareous soils. The hammer driven installation is used in sands, stiff clays, or stratified soil profiles.

In some embodiments pertaining to hammer driven installation, the follower diameter is smaller than the diameter of the caisson shell.

The foregoing has outlined rather broadly the features of the present disclosure in order that the detailed description that follows may be better understood. Additional features and advantages of the disclosure will be described hereinafter, which form the subject of the claims.

BRIEF DESCRIPTION OF THE DRAWINGS

In order that the manner in which the above-recited and other enhancements and objects of the disclosure are obtained, a more particular description of the disclosure briefly described above will be rendered by reference to specific embodiments thereof which are illustrated in the appended drawings. Understanding that these drawings depict only typical embodiments of the disclosure and are therefore not to be considered limiting of its scope, the disclosure will be described with additional specificity and detail through the use of the accompanying drawings in which:

FIG. 3(*a*) shows self-weight penetration of the anchor; FIG. 3(*b*) shows suction/driving penetration of the anchor; FIG. 3(*c*) shows retraction of follower after penetration; and FIG. 3(*d*) shows the installed anchor;

DETAILED DESCRIPTION

The particulars shown herein are by way of example and for purposes of illustrative discussion of the preferred embodiments of the present disclosure only and are presented in the cause of providing what is believed to be the most useful and readily understood description of the principles and conceptual aspects of various embodiments of the disclosure. In this regard, no attempt is made to show structural details of the disclosure in more detail than is necessary for the fundamental understanding of the disclosure, the description taken with the drawings making apparent to those skilled in the art how the several forms of the disclosure may be embodied in practice.

The following definitions and explanations are meant and intended to be controlling in any future construction unless clearly and unambiguously modified in the following examples or when application of the meaning renders any construction meaningless or essentially meaningless. In cases where the construction of the term would render it meaningless or essentially meaningless, the definition should be taken from Webster's Dictionary 3rd Edition.

Figure 1:
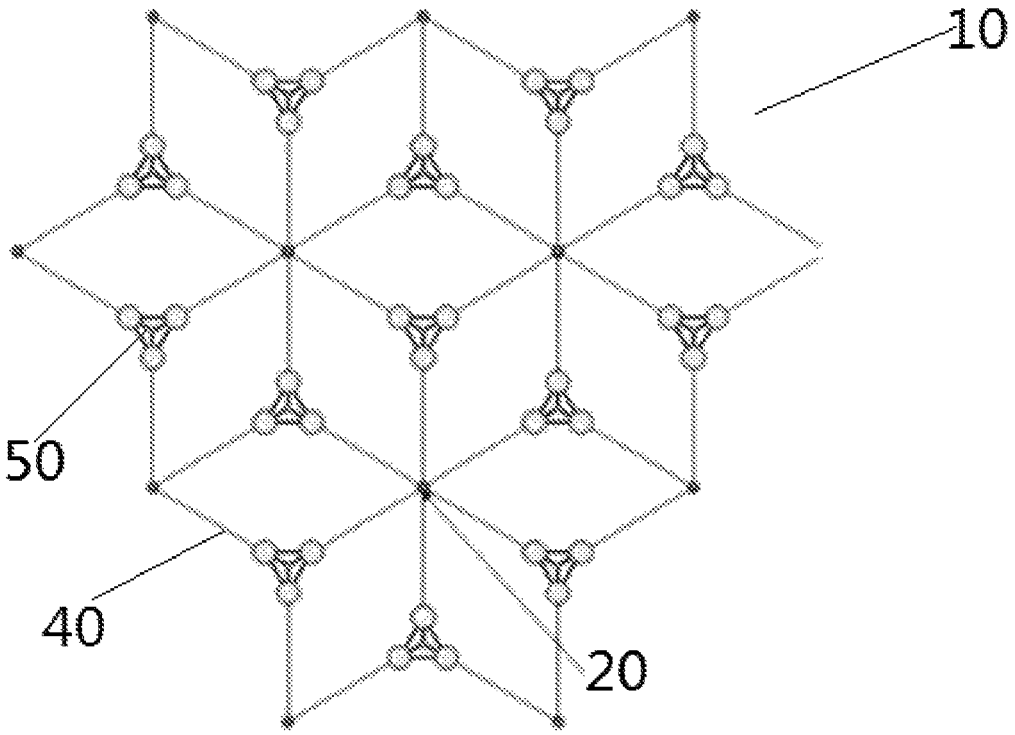
FIG. 1 shows a schematic view of a wind farm including offshore wind turbines and anchors.

Currently, each floating wind turbine has its own individual anchoring system which results in high capital cost of the system. A multiline anchor system may reduce this cost by allowing floating offshore wind turbines to share anchors, instead of each floating platform being moored by its own set. Referring to FIG. 1, a wind farm 10 includes a plurality of floating offshore wind turbines 50 and anchors 20 connected by mooring lines 40 in order to form a multiline mooring system. Each anchor 20 has six mooring lines 40 connected to six floating offshore wind turbines 50 around it, and each floating offshore wind turbine 50 couples to three mooring lines 40 belonging to three anchors around it respectively. An advantage of the disclosed system is that floating offshore wind turbine (FOWT) platforms can share anchors, resulting in each anchor in a FOWT wind farm serving multiple platforms and generating economies in the number of site investigations required and the number of anchors required.

In an embodiment, the anchoring system can be utilized for any structure that needs to be anchored to the seabed. In an embodiment, the structure could be utilized for wave power or as a floating barrier.

Conventional mooring systems utilize one mooring line per anchor. Conventional anchor alternatives comprise piles and caissons, drag embedded plates (DEAs), directly embedded plates (suction-embedded plate anchors (SEPLAs), dynamically embedded plate anchors (DEPLAs), and pile driven plate anchors (PDPAs)), and dynamically installed piles (DIPs). The multiline ring anchor attaches mooring lines from multiple units within an array of floating units to a single anchor. The circular cross-section of the multiline ring anchor permits simple multiple mooring line attachments to a single anchor. The foregoing achieves at least the following benefits: (a) Reduced geotechnical site investigation costs. Conventional practice for foundations for offshore wind towers typically comprise one exploratory boring or penetration test, along with supporting laboratory testing and geotechnical engineering evaluation, for each foundation. By reducing site investigation and engineering costs in rough proportion to the number of mooring lines attached to a single anchor, the multiline ring anchor design will dramatically reduce a major component of the capital costs for offshore wind farm development. (b) Reduced anchor installation costs. Installation costs include the labor and equipment associated with transporting the anchors from shore to the wind farm site and the costs of penetrating the anchor to its designated depth below the seabed. Installation has been proven possible in water depths exceeding 7,500 ft by suction and 5,000 ft by driving. These depths exceed the water depths currently envisioned for floating wind farms, aquaculture applications, and floating barriers for coastal protection. Therefore, water depth will not pose any limitations on the anticipated deployment of the multiline ring anchor. Anchor installation costs, also a major contributor to the capital costs for wind farm development, are reduced in rough proportion to the number of mooring lines per anchor.

Figure 2:
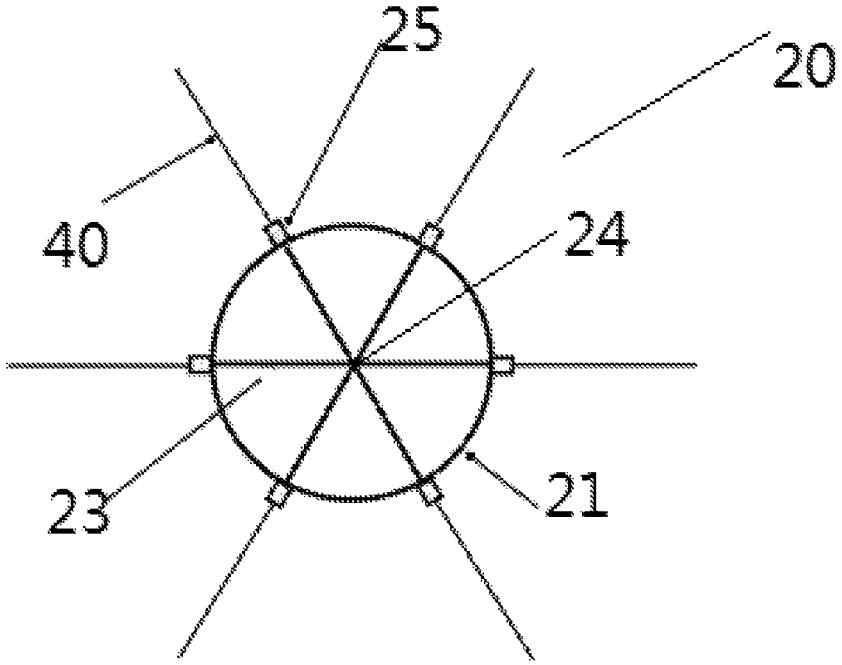
FIG. 2 is a cross-sectional view of a multiline ring anchor.

Referring to FIG. 2, a multiline ring anchor 20 is shown. The anchor includes a hollow cylindrical body 21 which has a shell with a thickness that is small compared to its inner diameter. The cylindrical body 21 has a vertical cylinder axis 24. The body 21 can be open at both ends to form a pile anchor. The cylindrical body 21 can also have a top plate (not shown) to form a suction anchor to provide a negative pressure inside the body when the anchor is installed. The anchor 20 has a plurality of pad-eyes 25 on the side of the body 21 and a plurality of mooring lines 40 which are attached to the pad-eyes respectively. The number of the pad-eyes and mooring lines are arbitrary and can be chosen according to application environment of the anchor. In an embodiment, both the number of the pad-eyes and mooring lines is six.

In some embodiment, to reinforce the shell of the cylindrical body 21, a plurality of plate stiffeners 23 are located in the body 21. The plate stiffeners serve at least the following purposes: (a) they provide structural reinforcement for the pile shell to resist concentrated forces transmitted by the mooring lines, and (b) they contribute to vertical pullout capacity of the ring anchor. The plate stiffeners 23 are plates parallel to the vertical cylinder axis 24. In an embodiment, the plate stiffeners are made of steel. In an embodiment, the plate stiffener can be comprised of a different material than steel, such as reinforced concrete or prestressed concrete. The plate stiffeners 23 can cross the vertical cylinder axis 24 and be welded to the shell of the cylindrical body 21. The number of the plate stiffeners 23 is arbitrary and can be chosen according to application environment of the anchor. In one embodiment, the number is two. In another embodiment, the number is three. The plate stiffeners 23 can be uniformly or non-uniformly distributed in the cylindrical body 21.

Figures 3A, 3B, 3C, 3D:
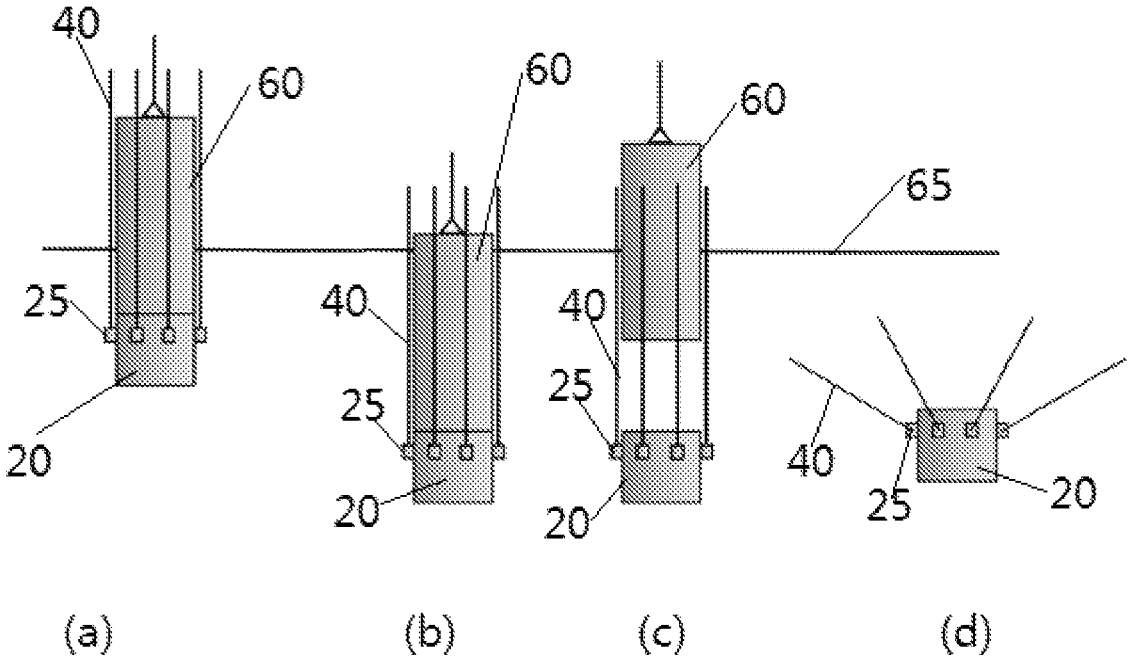
FIG. 3(*a*)-3(*d*) show the installation of a multiline ring anchor.

Referring to FIG. 3, the multiline ring anchor 20 is installed by attaching it to a cylindrical pile, termed a follower 60, which can be installed by either suction or hammer-driven penetration. After penetration to a designated depth, the follower 60 is extracted using conventional extraction methods, leaving a deeply embedded multiline ring anchor 20. FIG. 3(*a*) shows self-weight penetration of the multiline ring anchor 20; FIG. 3(*b*) shows suction/driving penetration of the multiline ring anchor 20; FIG. 3(*c*) shows retraction of follower 60 after penetration; and FIG. 3(*d*) shows the installed multiline ring anchor 20. The follower 60 is present in place of the upper portion of an anchor. The upper portion of the anchor contributes relatively little to load capacity because of the relatively weak soils in the shallow portions of most soil deposits. The multiline ring anchor 20 has an axisymmetric geometry; therefore, the multiline ring anchor 20 readily fits into a multiline mooring arrangement. Further, the ability to install the multiline ring anchor 20 by driving or suction makes the multiline ring anchor 20 feasible for the heterogeneous soil conditions typical of many locations likely to be considered for offshore wind power development. Finally, the multiline ring anchor 20 can mobilize substantial resistance to horizontal and vertical loading, rendering the multiline ring anchor 20 suitable for both catenary and semi-taut mooring systems.

In an embodiment, the multiline ring anchor 20 is embedded far below the seabed 65, where soil resistance is highest, thus providing a high pullout capacity relative to the weight of the multiline ring anchor 20. This is in contrast to conventional cylindrical anchors, piles and caissons, which have relatively low geotechnical efficiency, defined as the ratio of pullout capacity to anchor weight.

A high geotechnical efficiency of the multiline ring anchor 20, with associated benefits of reduced material and fabrication costs, is achieved at least as follows: (a) The mass of the multiline ring anchor 20 is concentrated deep beneath the seabed surface. At these depths, anchor pullout capacity is enhanced for at least two reasons: (1) the soil shear strength, from which the multiline ring anchor 20 pullout capacity derives, typically increases with depth, and pullout capacity increases in proportion to soil strength (the reaction of soil to an applied force) and (2) free surface effects, which reduce anchor capacity, are significantly reduced. (b) A single multiline ring anchor 20 effectively does the same work as several anchors in conventional single line systems. Numerical simulations indicate that, due to load cancellation effects, load demand on a multiline ring anchor 20 increases only slightly (and in some cases decreases) with an increasing number of line attachments. For example, a six-line system is expected to increase load demand on the multiline ring anchor 20 by a relatively modest 30%. High geotechnical capacity translates into reduced material costs. The modest increases in material costs associated with the need for additional pad-eyes and stiffeners will be more than offset by the reduced material costs made possible by the high geotechnical efficiency of the multiline ring anchor 20. Additionally, fewer multiline ring anchors 20 having reduced dimensions permits fewer vessel trips, smaller anchor handling vessels, and smaller anchor handling equipment.

The multiline ring anchor 20 is suitable for a wide range of soil seabed conditions, including soft clays, stiff clays, loose and dense sands, calcareous soils, and complex stratified soil profiles. The multiline ring anchor 20 can be installed in any soil profile for which suction or driving installation is possible. Additionally, the versatility of the multiline ring anchor 20 allows a single anchor type to be used throughout an entire site, even under conditions of extreme spatial variability in soil conditions. The foregoing provides a significant advantage over conventional anchor systems that are feasible for a relatively narrow range of soil conditions.

There is no strict embedment depth restriction on the multiline ring anchor 20; thus, virtually any embedment depth may be chosen to achieve the requisite pullout capacity of the multiline ring anchor 20. In soft clays, where suction installation is expected to be the preferred alternative, suction installation has proven capabilities for penetrating to at least 6 times the diameter of the multiline ring anchor 20. Therefore, for a multiline ring anchor 20 diameter of 20 feet, embedment depths into the seabed exceeding 100 feet are possible. In sandy seabeds, driving is expected to be a preferred method of installation, for which no limit exists in regard to maximum embedment depth. Dimension selection for the multiline ring anchor 20 in sand will therefore be a matter of project-specific optimization of combinations of anchor diameter and anchor embedment depths to minimize or to substantially reduce material and installation costs. For typical wind and wave loads transmitted to the multiline ring anchor 20 for floating wind turbine applications, multiline ring anchor 20 diameters in the range of 10 to 16 feet and embedment depths for 50 to 200 feet are anticipated.

The multiline ring anchor 20 can be precisely positioned both vertically and horizontally, leading to at least the following benefits: (a) Precise horizontal positioning permits the multiline ring anchor 20- to be configured within a geometric array such that proper clearances are maintained between floating units and tightly controlled mooring line lengths are achieved. (b) Precise vertical positioning enhances the reliability of the multiline ring anchor 20 by ensuring that sufficient embedment depth is attained to ensure that pullout capacity exceeds the load demand on the multiline ring anchor 20.

The multiline ring anchor 20 is versatile in regard to the types of load combinations that the multiline ring anchor 20 can withstand: (a) The deep embedment renders the multiline ring anchor 20 capable of resisting both horizontal and vertical loads; therefore, the multiline ring anchor 20 is suitable for catenary, semi-taut, and taut mooring systems. Catenary refers to the shape that a free hanging line assumes under the influence of gravity. The catenary system provides restoring forces through the suspended weight of the mooring lines. With a catenary system, the mooring line terminates at the seabed horizontally and the anchor point is only subjected to horizontal forces at the seabed. This requires that the mooring lines be relatively long compared to the water depth. The taut system is characterized in that the mooring lines are pre-tensioned until they are taut. In the taut system, the mooring line terminates at an angle at the seabed. A taut-leg system will usually have an angle of between 30 and 45 degrees. This means that in a taut mooring system, the anchor point is loaded by horizontal and vertical forces. The semi-taut system is a combination of the taut mooring system and catenary mooring system, wherein some parts of the mooring system are taut and other parts are catenary. (b) The deep embedment also provides robust resistance to torsional loading that can arise from misalignment (twist) of the anchor during installation or due to movement of the floating unit.

Figure 4:
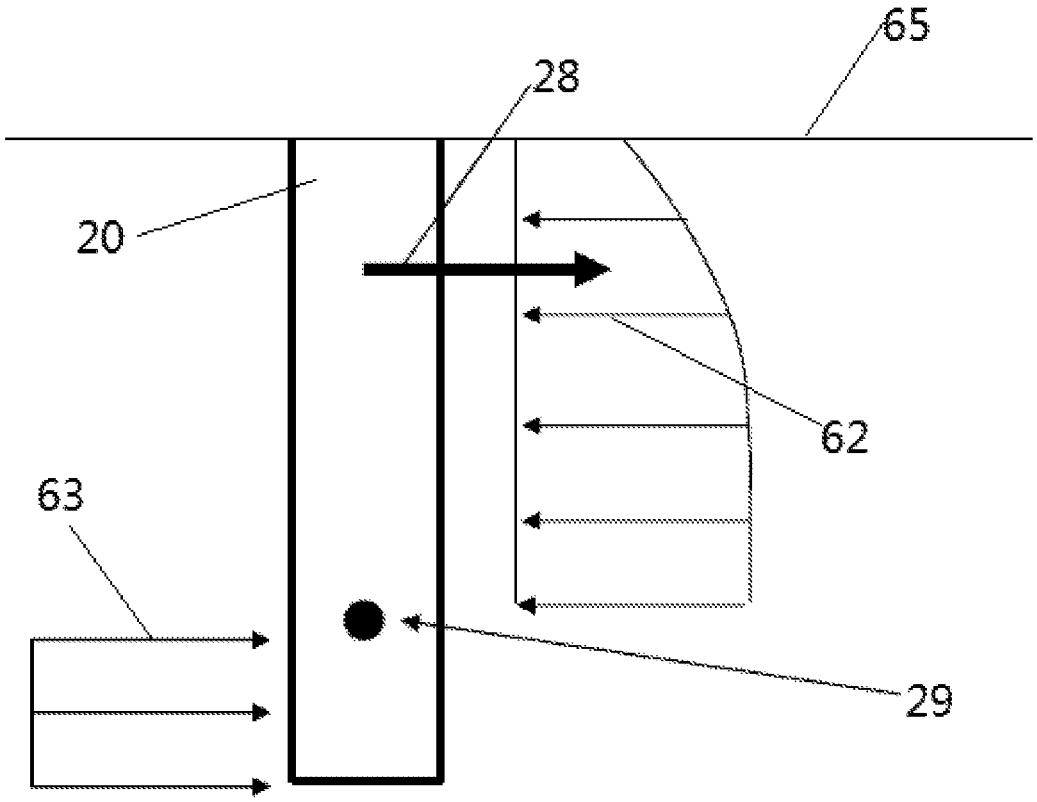
FIG. 4 shows forces acting on an anchor to make the anchor rotate.

In an embodiment, the attachment points (i.e., pad-eyes) of the mooring line to the multiline ring anchor 20 can be positioned arbitrarily. Referring to FIG. 4, the multiline ring anchor 20 is arranged under the seabed 65. A horizontal acting force 28 on the multiline ring anchor 20 produced by a mooring line can rotate the multiline ring anchor 20 around a center of rotational resistance 29 of the multiline ring anchor 20. The moment produced by horizontal resistance force 62 and 63 between a wall of the multiline ring anchor 20 and the surrounding soil can balance the moment produced by the horizontal acting force 28.

Figure 5:
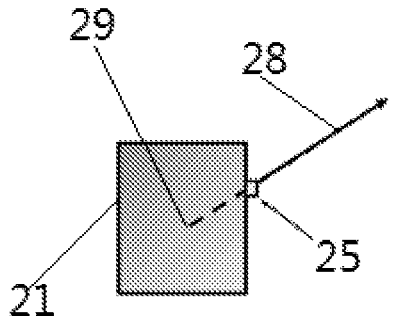
FIG. 5 shows the position of the pad-eye on the anchor to eliminate rotation.

In an embodiment, referring to FIG. 5, to reduce a moment acting on a cylindrical body 21 of the multiline ring anchor 20, the attachment points (i.e., pad-eyes 25) of the mooring line to the multiline ring anchor 20 are positioned such that the line of action of the resultant mooring line force 28 passes through the center of rotational resistance 29 (near the centroid) of the multiline ring anchor 20. Since moment loading significantly detracts from multiline ring anchor 20 pullout capacity, this feature serves to maximize or to substantially enhance pullout capacity of the multiline ring anchor 20.

Figures 6A, 6B:
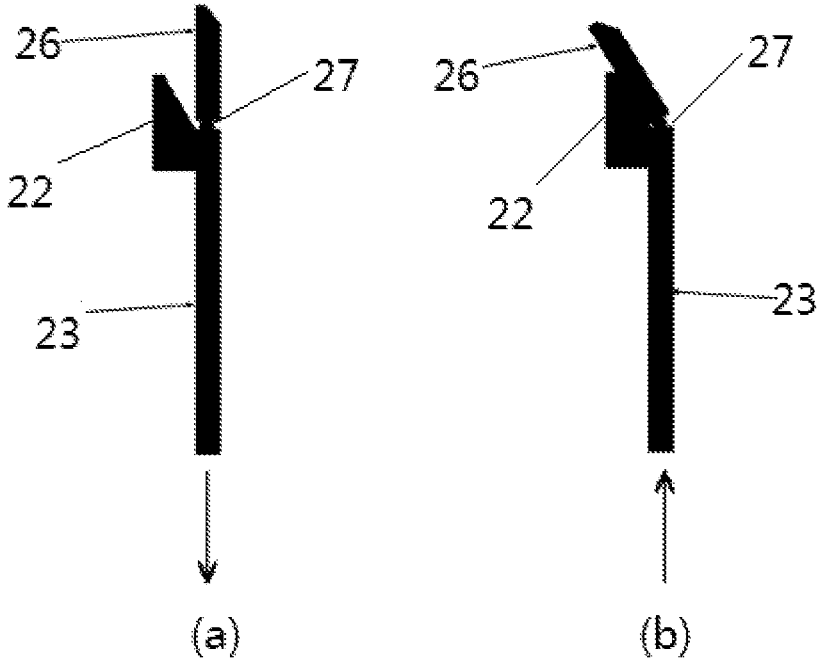
FIG. 6(*a*)-6(*b*) show a key-flap and a stiffener, wherein FIG. 6(*a*) shows a key-flap and a stiffener during the period of the downward motion during installation and FIG. 6(*b*) shows a key-flap and a stiffener during the period of the upward motion during loading.

Referring to FIG. 6, keying flaps 26 can optionally be attached to a top of stiffeners 23 through hinges 27 to enhance a vertical resistance to uplift. A keying flap 26 is a solid piece of plate attached to the top of the stiffener 23, and the keying flap 26 is free to rotate a limited angle away from the stiffener 23. The arrow direction represents the direction of movement of the multiline ring anchor 20. In FIG. 6(*a*), the stiffener 23 is in downward motion during installation, the shearing forces acting on the keying flap 26 make the keying flap 26 upright such that the resistance on the keying flap 26 is minimum. In FIG. 6(*b*), the stiffener 23 is in upward motion during loading, and the shearing forces act on the keying flap 26 to cause the keying flap 26 to rotate around the hinge 27 and engage with a stop 22 on the stiffener 23. The stop 22 limits the rotation of the keying flap 26 around the hinge 27. The keying flap 26 can provide extra bearing resistance against vertical displacements, thereby enhancing vertical resistance to uplift. The keying flap 26 can reduce soil resistance to multiline ring anchor 20 penetration during the installation process, when the multiline anchor 20 is moving downward, while enhancing soil resistance when the multiline anchor 20 moves upward in respond to vertical mooring line loads. The foregoing is achieved by a hinged keying flap 26 attached to the top of the plate stiffeners 23. When the multiline ring anchor 20 moves downward, the keying flap 26 naturally orients itself to a vertical alignment, such that the soil forces resisting the multiline ring anchor 20 penetration are reduced. By contrast, when the multiline ring anchor 20 moves upward in response to applied mooring line loads, the keying flap 26 rotates into an inclined orientation. This greatly increases the anchor bearing area available to resist vertical loads, thereby increasing the vertical load capacity of the multiline ring anchor 20.

Figure 7:
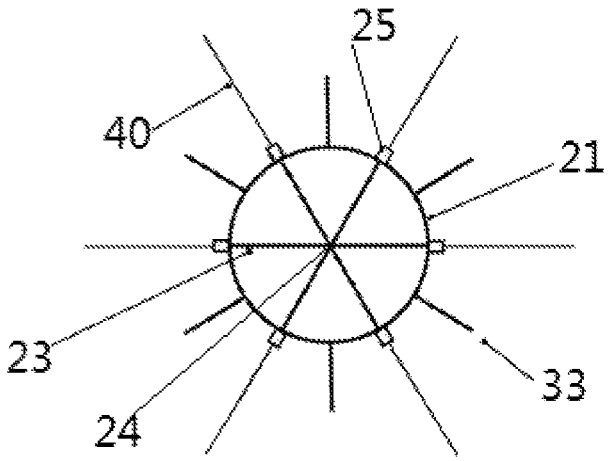
FIG. 7 is a cross-sectional view of a multiline ring anchor having wing plates.

Referring to FIG. 7, in one embodiment, the multiline ring anchor 20 further comprises a plurality of wing plates 33 attached to the outer sides of the cylindrical body 21, such that the horizontal load capacity of the multiline ring anchor 20 can be increased. This provides additional capability to fine tune the anchor design to add additional horizontal load resistance capacity without altering the multiline ring anchor 20 ring diameter, which can be constrained by installation considerations. The wing plates 33 are plates parallel to the vertical cylinder axis 24. In an embodiment, the wing plates are steel. In another embodiment, the plates are comprised of a material other than steel. The plane that the wing plate 33 lies in crosses the vertical cylinder axis 24. In an embodiment, the wing plates 33 are welded to the outer surface of the cylindrical body 21. The number of the wing plates is arbitrary and can be chosen according to application environment of the anchor. In a preferred embodiment, the number of the wing plates is 6. The wing plates 33 can be uniformly or non-uniformly distributed around the cylindrical body 21.

In an embodiment, the multiline ring anchor 20 can be installed by either suction or hammer driven installation. In soft clay profiles, the suction installation method can be appropriate. Suction installation can also be used in calcareous soils, provided stiff, cemented strata are absent from the profile. Suction installation can also be used in stiff clays and sands, but this method of installation typically requires small caisson aspect ratios (length/diameter), which preclude the deep anchor penetration needed for optimal functioning of the multiline ring anchor 20. Similarly, suction installation is difficult in highly stratified soils profiles. Therefore, driving is the installation method of choice for sands, stiff clays and stratified soil profiles. Driving installation can utilize impact hammers, vibratory hammers, and jetting, depending on soil conditions and considerations for reducing acoustic impacts.

Both suction and driving installation are established technologies. The primary focus of feasibility studies evaluating the multiline ring anchor 20 is whether the additional soil resistance to penetration associated with various elements of the multiline ring anchor 20 somehow renders suction or driven installation impractical. To this end, installation analyses were conducted for the same two sets of soil conditions considered in the pullout resistance study: a soft clay profile and a dense sand profile.

The suction installation process limits the aspect ratio of the caisson to an LID (L is the length of the anchor, D is the diameter of the anchor) less than 5 to 6 in soft clays and less than about 1 in stiff clays and sands. The small embedment in the latter case limits their capability for resisting vertical load, largely restricting their use to catenary mooring systems, unless ballast is added. Driven piles of any aspect ratio can be installed; however, long, slender piles generally have very low efficiency in resisting horizontal loads, so there is little incentive to adopt a flexible pile to resist mooring line loads from catenary and semi-taut systems. Thus, for the purpose of the comparative evaluations presented herein, a suction caisson and an efficiently designed driven pile (L/D less than 10) behave similarly from a structural standpoint, in that they rotate and/or translate as a rigid body in a vertical plane. Their chief difference is that suction installation imposes a limitation on the aspect ratio to less than 6. In addition to having no particular limitation on aspect ratio, driven piles can be installed in most soil profiles, excepting certain extreme conditions, such as a high occurrence of boulders.

In the case of suction installation, sufficient underpressure must be applied to overcome soil resistance, thereby advancing the pile. However, avoiding heave of the plug of soil inside the caisson imposes an upper limit on the amount of underpressure that may be safely applied. The purpose of a suction installation analysis is to determine whether sufficient suction can be applied to an anchor to overcome soil resistance to penetration without inducing a plug heave failure. Soil resistance to suction installation typically includes end bearing resistance from the pile tip, side friction from the inner and outer walls, and resistance from various structural stiffeners. The multiline ring anchor 20 can encounter a greater resistance to penetration than most suction piles due to the additional stiffeners and, possibly, the wing plates. Suction installation of the multiline ring anchor 20 reinforced by three internal stiffeners is possible without exceeding installation underpressures that could trigger instability in the internal soil plug.

In the case of driven installation, concerns include at least penetrating the pile to its designated depth using a commercially available hammer without encountering premature refusal and without overstressing the pile. The analysis and issues for multiline ring anchor 20 installation parallel those for conventional pile installation, except that the plate stiffeners 23 and wing plates 33 will generate unusually high tip resistance.

Multiline loading on terms of a simple anchor can be expressed in resultant force from the combined loads. Thus, the pullout resistance calculation can be conducted within the same framework as a single line anchor. However, there was a question as to whether the multiline arrangement results in excessively large loads that cannot be resisted by an anchor having acceptable dimensions. Prior publications on multiline loading on suction caissons include: 1) Burns M. (2013), 3d Finite Element Analysis of Ultimate Capacity of Suction Caissons under Multi-Line loading, Master of Science Thesis, University of Maine, Orono, 270p. This study involved finite element simulations of a caisson subjected to two orthogonal mooring line loads. A finding from the study was that the resolved load capacity under two orthogonal loads was 6% greater than the load capacity under single line monotonic loading. 2) Chung J, (2012) Physical Modeling of Suction Caissons Loaded in Tow Orthogonal Directions for Efficient Mooring of Offshore Wind Platforms, Master of Science Thesis, University of Maine, Orono, 169p. This study involved centrifuge modeling of a caisson subjected to two orthogonal mooring line loads. A finding of the study was that the resultant peak load resistance for the 2-line system exceeded that of a single line system by 31%. This experimental finding is consistent with the finite element predictions that the resolved load capacity under multiline loading is comparable to the load capacity of a single-line mooring. 3) Fontana C, Arwade S, DeGroot D, Hallowell S, Landon M, Aubeny C, Diaz B, Myers A, Najjar J, Osmutlu S (2017) "Anchor forces in floating wind farms using multiline anchors". This study investigated multiline anchors and calculated the effects of multiple mooring line attachments to a single anchor on the overall load demand on the anchor. The findings indicated that, for the case of 3 mooring lines attached to a single anchor, the load demand on the anchor actually decreases due to load cancellation effects. In the case of 6 mooring lines attached to a single anchor, the resultant mooring line force on the anchor increases by about 30%. The anchors analyzed in these studies were conventional caissons extending from the seabed to a designated tip depth and did not include embedded rings.

Due to load cancellation effects, multiline loading does not generate excessive load demand on an anchor. In fact, simulations for some configurations actually show reduced load demand on an anchor due to the effects of loads from different directions cancelling one another. More generally, the maximum increase in load demand on an anchor due to multiline attachments appears to be on the order of 30%.

Figure 8:
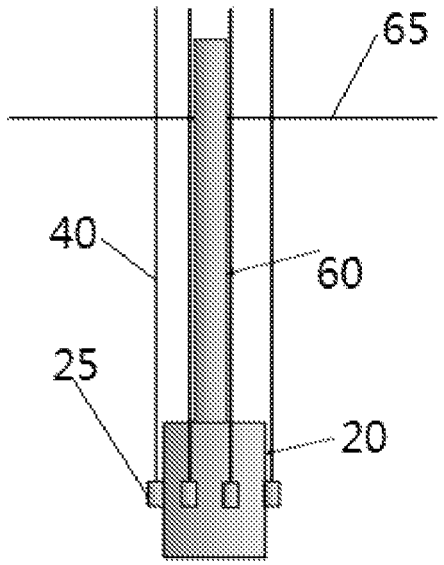
FIG. 8 shows a reduced follower diameter for driving installation.

Referring to FIG. 8, installation performance can be optimized by reducing the diameter of the follower 60 relative to the ring diameter. In an embodiment, a large follower 60 diameter is needed for suction installation in order to penetrate the anchor into the soil. However, for driving installation in stiff clays and sands, a reduced follower 60 diameter has at least the following benefits: (a) it reduces driving resistance to penetration, thereby permitting a smaller ram, and (b) it reduces the zone of soil disturbance above the ring, thereby reducing the potential for reduced vertical pullout resistance due to installation disturbance effects.

The multiline ring anchor 20 can be used for any system having wide horizontal dimensions such that multiple mooring line attachments to the system can be secured by a single anchor. In an embodiment, the horizontal dimensions are on the order of hundreds of feet. In an embodiment, such systems can float on the water surface or be submerged at a fixed elevation above the seabed. This multiline ring anchor 20 can provide solutions for applications including, but not limited to, energy, aquaculture, and coastal protection. Energy applications include, but are not limited to, floating wind farms, wave energy, and current energy. Aquaculture applications include, but are not limited to, fish and seaweed farms comprising large floating or submerged structures secured to the seabed by arrays of anchors. Coastal protection applications include, but are not limited to, floating breakwaters (e.g., wave attenuators) for protecting marinas, ports and harbors.

Examples

Example 1. Horizontal and Vertical Components of Loading

This example demonstrates the ability of the multiline ring anchor 20 to resist anticipated mooring line loads from floating offshore wind turbine units. It is predicted that mooring line loads from a floating wind turbine can be resisted by the multiline ring anchor 20 without resort to selecting impractically large anchor dimensions. Horizontal and vertical components of loading are considered in this example. In catenary systems, the mooring line is horizontal at the seabed but typically inclined at about 15 degrees at the depth of the anchor. In semi-taut systems, a load inclination angle of about 30 degrees is typical. This example also considers two extremes of soil profile in terms of seabed soil strength. The two extremes of soil profile for seabed soil strength are soft clay and dense sand.

Anchor Capacity in a Soft Clay Profile

Figures 9A, 9B:
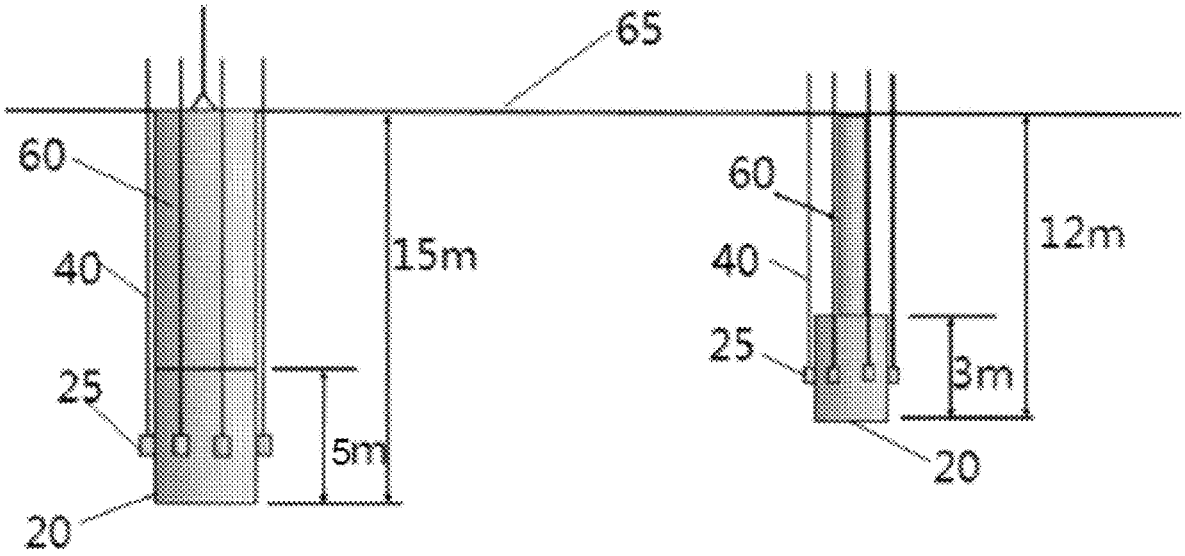
FIG. 9(*a*)-9(*b*) show anchor properties used in capacity studies, wherein FIG. 9(*a*) shows anchor capacity in a soft clay profile and FIG. 9(*b*) shows anchor capacity in a dense sand profile.

The soil profile selected for this analysis has a typical soft clay soil strength profile that has an undrained shear strength at the seabed of $S_{um}$=5 kPa and increases linearly with depth at a strength gradient of k=2 kPa/m. A soil-pile adhesion factor of 0.7 was used in the analysis. Referring to FIG. 9(*a*), the multiline ring anchor 20 for this analysis has a tip embedment depth of 15 m, a diameter of 3 m and a length of 5 m. Based on the horizontal load capacity analysis, the mooring lines 40 are attached at the two-thirds depth of the multiline ring anchor 20, or 13 m below the seabed. This attachment depth minimizes or substantially reduces the potential for multiline ring anchor 20 rotation, thereby maximizing horizontal load capacity. The tube section has a wall thickness of 0.05 m. To provide reinforcement for six mooring lines 40, three 0.08 m thick by 1 m high plate stiffeners 23 are provided. No wing plates are included in the design for this analysis.

Figure 10:
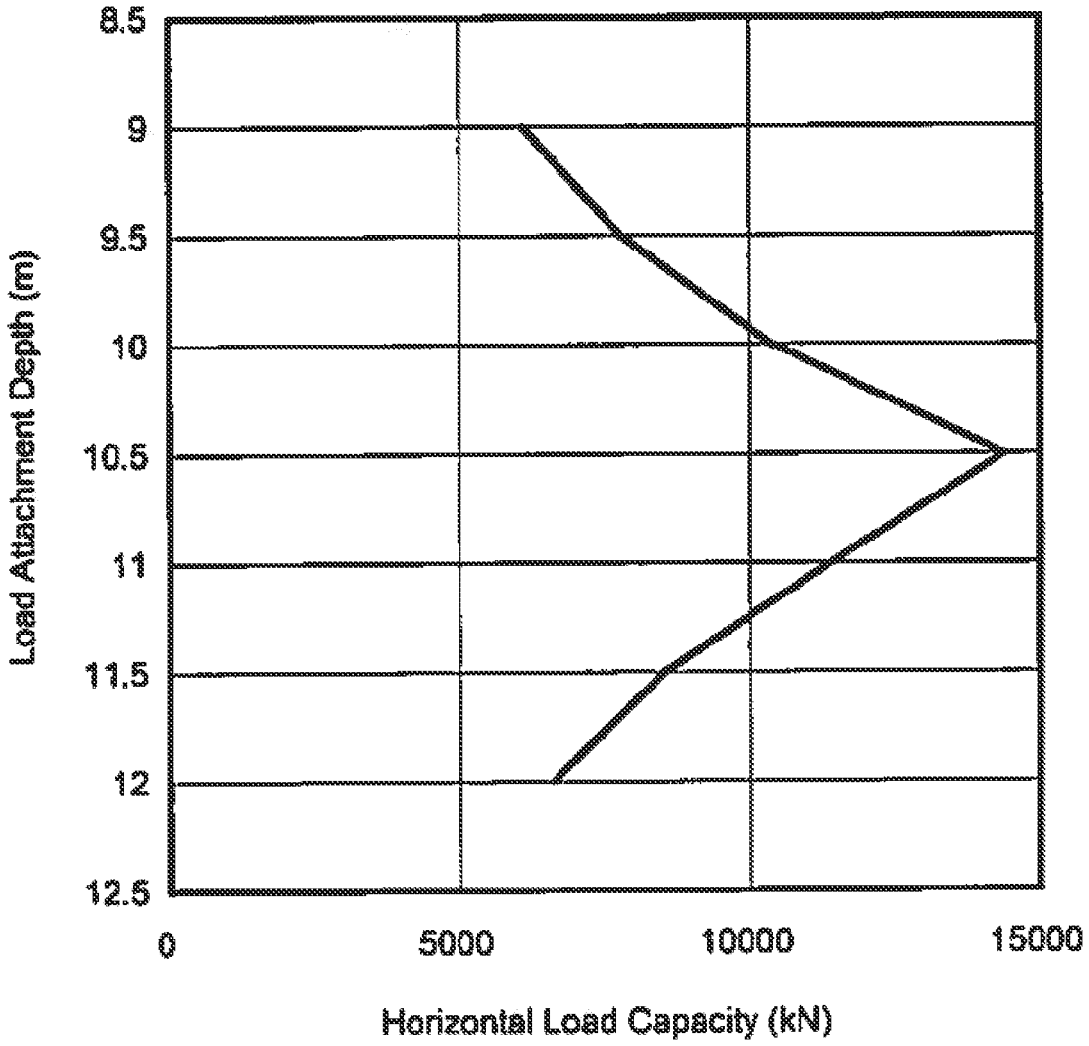
FIG. 10 shows horizontal load resistance of multiline ring anchor in clay.

The horizontal capacity analysis for the multiline ring anchor 20 is performed for a range of load attachment depths. Thus, in addition to predicting the resistance of the multiline ring anchor 20 to horizontal loads, it also provides information on the optimal location for attaching the mooring line. FIG. 10 shows the profile of computed horizontal load capacity versus load attachment depth for this anchor. The analysis shows a maximum horizontal load capacity of 5,400 kN, corresponding to a mooring line 40 attachment located 2 m above the tip of the anchor.

Vertical pullout resistance is comprised of end bearing and frictional resistance, as well as the submerged weight of the anchor. In computing this capacity, at least two pullout mechanisms can occur: (1) upward movement of the anchor that leaves the internal plug of soil inside the pile in place, and (2) upward movement of the pile and the internal plug of soil. Reported vertical capacity is based on the mechanism that gives the least resistance. In the case considered, upward movement of the anchor that leaves the internal plug of soil inside the pile in place controls. Table 1 presents the various components of resistance to vertical loaded generated by the ring anchor.

TABLE 1

| Component | Tubular Section | Plate Stiffeners | Total |
|---|---|---|---|
| End Bearing at Top Section | 0 kN | 209 kN | 209 kN |
| Reverse End Bearing at Bottom of Section | 162 | 223 | 385 |
| Skin Friction | 1,946 | 377 | 2,323 |
| Submerged Weight | 156 | 47 | 203 |
| Total | 2,264 | 856 | 3,120 |

Taking an estimated 2,500 kN peak load demand for a floating offshore wind turbine together with an estimated 15-degree load angle associated with a catenary mooring system leads to a horizontal load demand of 2,400 kN and a vertical load demand of 647 kN. Noting that common practice requires a safety factor FS=1.5 for the predominantly horizontal load demand associated with a catenary system, the ring anchor under consideration can easily meet the load demand.

The inclined pullout resistance capacity of the anchor can be considered by taking the resultant of the horizontal and vertical capacities. The resultant is computed to be 6,246 kN inclined at an angle of 30 degrees. Some reduction in this value can occur due to combined vertical-horizontal loading interaction effects. Here, the reduction is 10%. Additionally, a higher safety factor is usually required for anchors subjected to a significant component of vertical loading as occurs in semi-taut and taut mooring systems, typically FS=2. However, the calculations clearly show that the multiline ring anchor provides adequate levels of pullout load resistance, even when interaction effects and the need for higher safety factors under inclined loading are taken into consideration.

The multiline ring anchor 20 has a geotechnical efficiency, defined as total pullout capacity divided by total anchor weight, of 27. This is somewhat less than that which can be achieved by a plate anchor, which can approach 40. However, a plate anchor permits only a single mooring line attachment, while the multiline anchor can accommodate six mooring lines 40. When a 6-fold multiplier is factored into the efficiency calculation, the multiline ring anchor 20 is essentially four times more efficient than the most efficient single-line anchor.

Anchor Capacity in a Dense Sand Profile

Referring to FIG. 9(*b*), the multiline ring anchor 20 capacity evaluation in a dense sand profile was performed for a 2 m diameter by 3*m* long ring anchor penetrated to a tip depth of 12 m. The thickness of both the tube wall and the stiffeners 23 was taken as 0.05 m. The stiffeners 23 had a height of 1 m. No wing plates were utilized. The analysis was performed for a soil internal friction angle of 45 degrees. The soil-pile interface friction angle was taken as 90% of the internal friction angle of the soil. Additionally, the friction angle was reduced by 20% for bearing resistance calculations to take into account installation disturbance effects above the multiline ring anchor 20.

Figure 11:
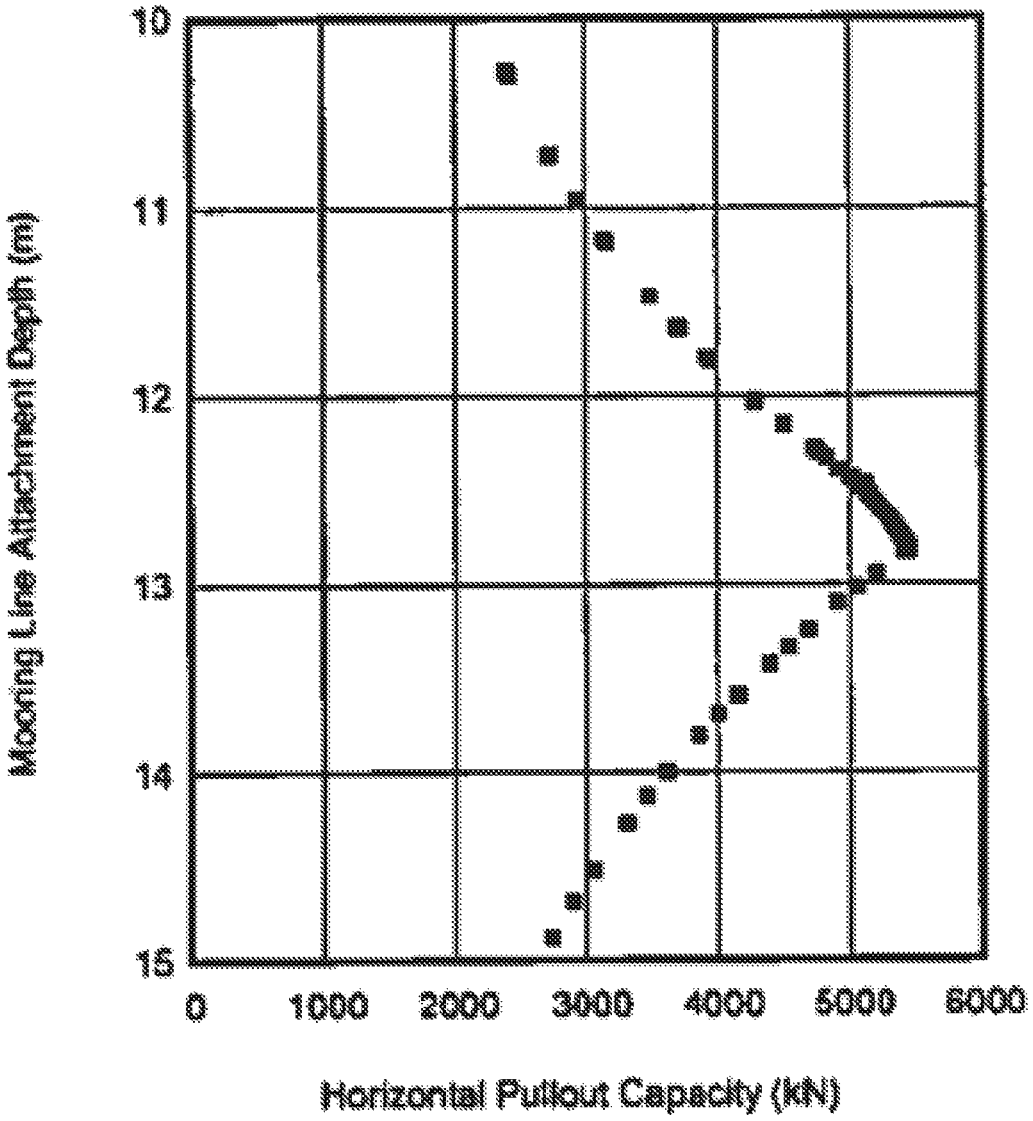
FIG. 11 shows horizontal load resistance of multiline ring anchor in dense sand.

Horizontal load capacity was evaluated using a virtual least upper bound analysis similar to that performed for the ring anchor in clay. FIG. 11 shows the profile of computed horizontal pullout capacity versus mooring line 40 attachment depth for the multiline ring anchor 20. The load attachment depth was varied to identify the optimal load attachment location as well as determine maximum horizontal load capacity. As is evident from FIG. 11, the multiline ring anchor 20 has ample horizontal capacity to withstand anticipated load demand from a floating offshore wind turbine.

Table 2 shows the components of vertical pullout resistance from various components of the multiline ring anchor 20. For the selected multiline ring anchor 20, the vertical pullout capacity well exceeds the anticipated load demand for a floating offshore wind turbine. A smaller anchor would actually be adequate to resist the 2,500 kN mooring line load alluded to earlier.

TABLE 2

| Component | Tubular Section | Plate Stiffeners | Total |
|---|---|---|---|
| End Bearing at Top Section | 1,041 kN | 1,022 kN | 2,063 kN |
| Skin Friction | 3,296 | 974 | 4,270 |
| Submerged Weight | 62 | 19 | 81 |
| Total | 4,399 | 856 | 6,414 |

Example 2. Multiline Ring Anchor Installation

This example demonstrates the feasibility of safely penetrating the multiline ring anchor 20 to the embedment depths needed to achieve the requisite pullout capacity. In soft clays, suction installation is considered to be the installation method of choice. While suction installation is possible in sands, it usually involves embedment of large diameter piles to shallow depths. To maximize or to substantially enhance efficiency, embedding a relatively small diameter anchor to a greater depth is more effective. For this reason, driven installation is preferred for a sand seabed.

Installation in a Soft Clay Profile

The soil profile selected for this analysis has a typical soft clay soil strength profile that has an undrained shear strength at the seabed of $S_{um}$=5 kPa, and increases linearly with depth at a strength gradient of k=2 kPa/m. A soil-pile adhesion factor of 0.3 was used in the side friction calculations and bearing factors $N_c$=9 and 7.5 were used in the respective end bearing resistance calculations for the annular tube and the plate stiffeners 23.

The ring anchor selected for the study (from FIG. 9(*a*)) has a tip embedment depth of 15 m, a diameter of 3 m and a length of 5 m. The tube section has a wall thickness of 0.05 m. To provide reinforcement for six mooring lines 40, three 0.08 m thick by 1 m high plate stiffeners 23 are provided. No wing plates are included in this design for this analysis. A submerged weight of the caisson W=203 kN was used in the analysis.

In estimating the additional resistance to penetration from the six mooring lines 40 (chains), a chain stock diameter of 0.073 m was used. To account for the enhanced area due to the chain links, a multiplier of 2.5 was applied to the nominal surface area of the chain. Due to the rough surface of the chain, an adhesion factor of 1.0 was used in the side resistance calculation. The submerged weight of the chain was conservatively omitted from the driving force calculation.

Figure 12:
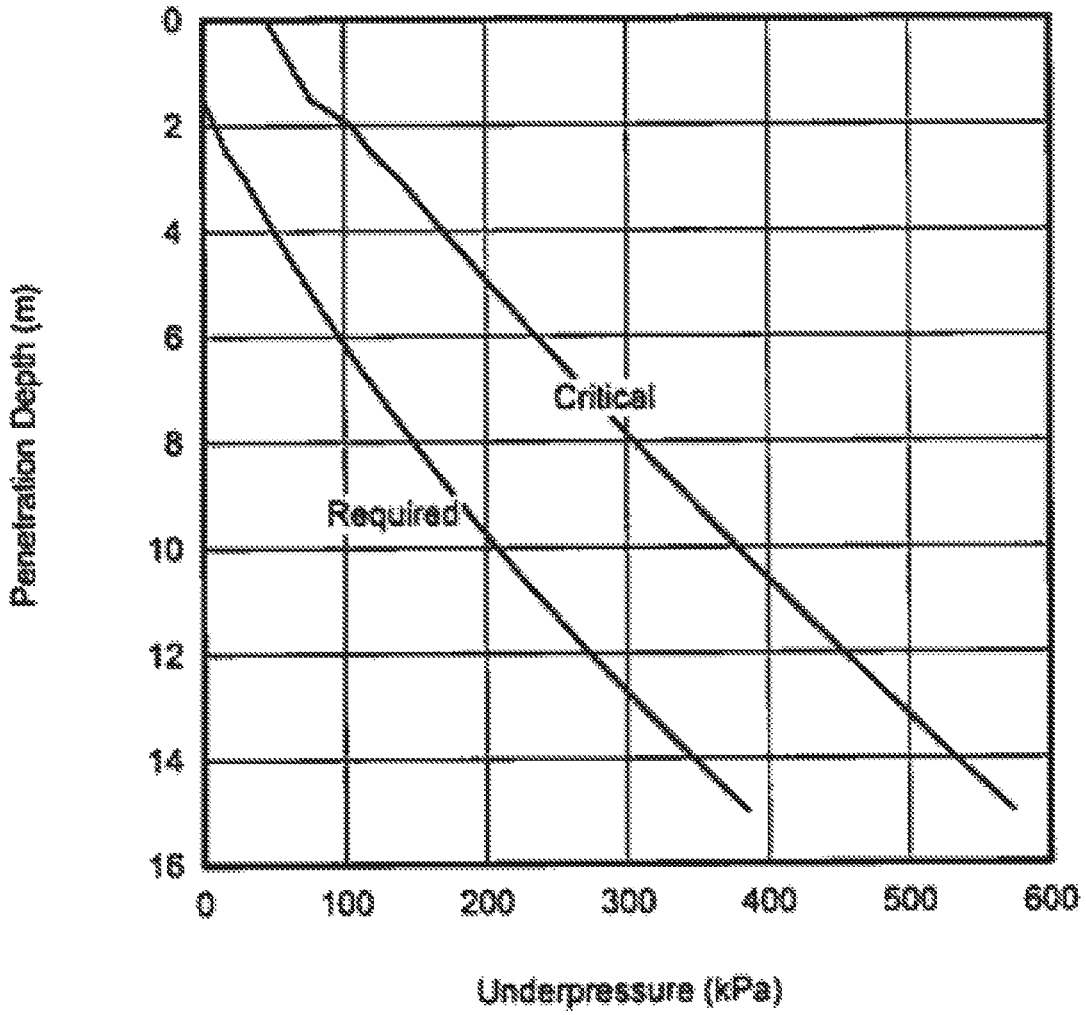
FIG. 12 shows required and critical underpressure for anchor installation in clay.

FIG. 12 shows the estimated required and critical underpressure as a function of penetration depth. At the full embedment depth, the safety factor against failure of the internal soil plug is 1.49. Given that the weight of the chains was neglected in this calculation, this is considered acceptable. Table 3 summarizes the various contributions to resistance to penetration. The atypical number of chains associated with the multiline ring anchor mooring system is seen to not be a major contributor. Noting that a multiline anchor requires more stiffening elements, resistance from the plate stiffeners becomes a significant component of overall soil resistance to penetration. However, as noted above, the underpressure required to overcome this resistance is still safely below the critical underpressure.

TABLE 3

| Component | Contribution | Resistance (kN) | % of Total |
|---|---|---|---|
| Tubular Segment | Skin Friction Inner Wall | 848 | 66.1 |
| | Skin Friction Outer Wall | 820 | |
| | End Bearing at Tip | 148 | |
| Array of Three Stiffeners | End Bearing at Tip | 167 | 31.4 |
| | Reverse End Bearing at Top | 157 | |
| | Skin Friction | 539 | |
| Appurtenances | 6 Chains | 69 | 2.5 |
| | Total | 2,748 | 100 |

Driving Installation in a Dense Sand Profile

The multiline ring anchor 20 selected for the study (FIG. 9(*b*)) has a tip embedment depth of 12 m, a diameter of 2 m and a length of 3 m, the diameter of the follower 60 is 0.6 m. The sand profile selected for this analysis was a dense uniform sand having a density of 10 kN/m$^3$ and a friction angle of 45°. Wall thickness for the tubular sections and all stiffening elements of the multiline ring anchor 20 were taken as 0.05 m. The follower 60 had a diameter of 0.6 m with a wall thickness of 0.12 m. Table 4 summarizes the relevant parameters for the pile driving analysis.

TABLE 4

| Input | Value |
|---|---|
| Tip bearing factor | 135 |
| Side friction angle | 40.5 degrees |
| Total static resistance | 12,400 kN |
| Tip static resistance | 9,570 kN |
| Quake, side resistance | 0.0025 m (0.1 inch) |
| Quake, tip resistance | 0.0025 m (0.1 inch) |
| Damping, side resistance | 0.16 sec/m (0.05 sec/ft) |
| Damping, tip resistance | 0.49 sec/m (0.15 sec/ft) |
| Total weight of ring anchor and follower | 24.5 kN |

The wave equation analysis for pile penetration showed that with a ram weight of 530 kN, driving the multiline ring anchor 20 to full penetration depth could be achieved with a maximum penetration rate of 238 blows/0.3 m, which is considered acceptable. Maximum driving stresses were estimated at 186 MPa, which can be resisted by a high strength steel. It is noted that other methods of driving installation are possible, in particular vibratory installation.

Example 3. Comparative Evaluations

Comparative evaluations of the various anchor alternatives can proceed in two stages. The first stage eliminates alternatives that simply do not work for the soil and loading conditions under consideration. For example, the shallow embedment depth of a DEA in sand or stiff clay precludes any possibility of mobilizing the vertical load demand imposed by a semi-taut mooring system, effectively eliminating a DEA from consideration for this type of condition.

Table 5 summarizes the first stage of evaluation, where Y (yes) denotes that the anchor is suitable for a given combination of soil and loading conditions, while N (no) indicates that it is not. For example, a drag embedded anchor will likely penetrate deeply into a soft clay profile and thus be capable of resisting substantial resistance to uplift loads. This function would be better served by a vertically loaded anchor, which is specifically designed for that purpose. Another need for qualification arises from limited data or research on a given option. For example, suction installation of a plate to a shallow depth is likely to be feasible, so such an anchor could conceivably function in a catenary system.

TABLE 5

| Soil Profile | Moor Syst | Pile | SCA | DEA | VLA | SE-PLA | DE-PLA | PD-PA | DIP | MRA |
|---|---|---|---|---|---|---|---|---|---|---|
| Soft clay | Catenary | Y | Y | Y | Y | Y | Y | Y | Y | Y |
| | Semi-taut | Y | Y | Y* | Y | Y | Y | Y | Y | Y |
| Stiff clay | Catenary | Y | Y | Y | Y | Y | Y | Y | Y | Y |
| | Semi-taut | Y | N | N | N | N | N | Y | N | Y |
| Sand | Catenary | Y | Y | Y | N | Y | Y | Y | Y | Y |
| | Semi-taut | Y | N | N | N | N | N | Y | N | Y |
| Stratified | Catenary | Y | Y | Y | N | Y | Y | Y | N | Y |
| | Semi-taut | Y | N | N | N | N | N | Y | N | Y |

*Non-optimal use of anchor

Based on outcomes summarized in Table 5, quantitative cost comparisons will be performed for the following cases: Case 1 is catenary moorings in soft clay. Since all anchor alternatives are viable in soft clay profile, the relative merits of each alternative, can be evaluated. Case 2 is semi-taut moorings in soft clay. While this case is superficially similar to Case 1, the fact that the anchor must be deeply embedded to provide resistance to uplift can alter the relative merits of the various anchor systems. For example, with increasing embedment depth, plate anchors become increasingly resistant to out-of-plane loading, leading to a more favorable comparison to pile/caisson anchors. Case 3 is catenary moorings in stiff clay, sand, and stratified soils. Since catenary mooring systems require minimal vertical load resistance from the anchors, anchors which are incapable of deep penetration into these soil profiles are potentially competitive alternatives. Case 4 is semi-taut moorings in stiff clay, sand, and stratified soils. The vertical load demand from semi-taut mooring systems restricts the range of alternatives to anchors that are capable of penetrating into resistant soil profiles. Three anchors fall into this category: piles, pile driven plate anchors, and the multiline ring anchor 20.

All of the compositions and methods disclosed and claimed herein can be made and executed without undue experimentation in light of the present disclosure. While the compositions and methods of this disclosure have been described in terms of preferred embodiments, it will be apparent to those of skill in the art that variations may be applied to the compositions and methods and in the steps or in the sequence of steps of the methods described herein without departing from the concept, spirit and scope of the disclosure. More specifically, it will be apparent that certain apparatus can be substituted for the apparatus described herein while the same or similar results would be achieved. All such similar substitutes and modifications apparent to those skilled in the art are deemed to be within the spirit, scope and concept of the disclosure as defined by the appended claims.

What is claimed is:

1. A multiline ring anchor comprising:

a hollow cylindrical body, a plurality of pad-eyes attached to the outer surface of the hollow cylindrical body, and a plurality of mooring lines;

wherein each of the mooring lines a plurality of plate stiffeners in the hollow cylindrical body; and a plurality of keying flaps attached to the plate stiffeners; is attached to one of the plurality of pad-eyes;

wherein each of the plurality of pad-eyes is positioned such that a line of action of a resultant mooring line force is configured to pass through a center of a rotational resistance of the anchor.

2. The multiline ring anchor of claim 1, further comprising a plurality of wing plates appended to the outer surface of the hollow cylindrical body.

3. The multiline ring anchor of claim 2, wherein each of the plurality of wing plates is parallel to a vertical cylinder axis of the hollow cylindrical body.

4. The multiline ring anchor of claim 2, wherein the number of the plurality of wing plates is six.

5. The multiline ring anchor of claim 1, wherein the multiline ring anchor is a suction anchor.

6. The multiline ring anchor of claim 1, wherein both ends of the hollow cylindrical body are open.

7. The multiline ring anchor of claim 1, wherein each of the plurality of plate stiffeners is parallel to a vertical cylinder axis of the hollow cylindrical body.

8. The multiline ring anchor of claim 1, wherein each of the plurality of plate stiffeners cross a vertical cylinder axis of the hollow cylindrical body.

9. The multiline ring anchor of claim 1, wherein the number of the plurality of plate stiffeners is six.

10. The multiline ring anchor of claim 1, wherein the number of the plurality of mooring lines is six.

11. The multiline ring anchor of claim 1, further comprising a plurality of hinges connecting the keying flaps and the plate stiffeners.

12. A multiline ring anchor comprising:

a hollow cylindrical body;

a plurality of pad-eyes attached to the outer surface of the hollow cylindrical body;

a plurality of mooring lines, wherein each of the mooring lines is attached to one of the plurality of pad-eyes;

a plurality of plate stiffeners in the hollow cylindrical body; and a plurality of keying flaps attached to the plate stiffeners.

13. The multiline ring anchor of claim 12, further comprising a plurality of hinges connecting the keying flaps and the plate stiffeners.

14. A method for installing a multiline ring anchor, comprising:

attaching the multiline ring anchor to a follower wherein the multiline ring anchor includes;

a hollow cylindrical body;

a plurality of plate stiffeners in the hollow cylindrical body; and a plurality of keying flaps attached to the plate stiffeners;

penetrating the follower to a designated depth;

extracting the follower;

leaving the multiline ring anchor embedded the depth; and attaching a plurality of mooring lines from a plurality of floating units to the multiline ring anchor.

15. The method of claim 14, wherein the multiline ring anchor is installed by suction installation.

16. The method of claim 15, wherein the suction installation is used in soft clay profiles or calcareous soils.

17. The method of claim 14, wherein the multiline ring anchor is installed by hammer driven installation.

18. The method of claim 17, wherein the hammer driven installation is used in sands, stiff clays, or stratified soil profiles.

19. The method of claim 18, wherein the follower diameter is smaller than the diameter of the multiline ring anchor.

* * * * *